US006068443A

United States Patent [19]

Aoki et al.

[11] Patent Number: 6,068,443

[45] Date of Patent: May 30, 2000

[54] GAS TURBINE TIP SHROUD BLADE CAVITY

[75] Inventors: Sunao Aoki; Eisaku Ito, both of Takasago, Japan

[73] Assignee: Mitsubishi Heavy Industries, Ltd., Tokyo, Japan

[21] Appl. No.: 09/023,566

[22] Filed: Feb. 13, 1998

[30] Foreign Application Priority Data

Mar. 26, 1997 [JP] Japan ..... 9-073331

[51] Int. Cl.[7] ..... F01D 5/20

[52] U.S. Cl. ..... 415/173.5; 415/173.1; 415/173.6; 415/174.5; 416/189

[58] Field of Search ..... 415/173.1, 173.4, 415/173.5, 173.6, 174.5; 416/189, 192, 195

[56] References Cited

U.S. PATENT DOCUMENTS 3,314,651 4/1967 Beale ..... 415/173.6
4,161,318 7/1979 Stuart et al. ..... 277/53
5,188,507 2/1993 Sweeney ..... 415/173.1
5,205,706 4/1993 Belcher ..... 415/105

*Primary Examiner*—Edward K. Look
*Assistant Examiner*—Ninh Nguyen
*Attorney, Agent, or Firm*—Wenderoth, Lind & Ponack, L.L.P.

[57] ABSTRACT

The invention relates to a cavity constituted by a casing of a gas turbine and a moving blade with a tip shroud, by which a cavity space is made to a necessary minimum size, a main flow gas is prevented from being entrained and a pressure loss is reduced. A tip shroud (6) is mounted on a tip end portion of a moving blade (4), a fin (7) is mounted thereon, a recess-like cavity (15) narrower than the conventional one is formed by portions (12*a*) and (12*b*) of a casing (12) and the fin (7), and further a projecting portion (16) is provided to an upstream end portion of the tip shroud (6). The projecting portion (16) is at a position (13*a*) at a time of a cold start and is at a position (13*b*) at a time of a hot start run, even if a thermal expansion occurs, thus the projecting portion (16) is not in contact with the recess portion, a main flow gas (1) is less entrained within the cavity (15), and a pressure loss is reduced because of no swirl, so that a performance of the gas turbine is enhanced.

3 Claims, 2 Drawing Sheets

GAS TURBINE TIP SHROUD BLADE CAVITY

BACKGROUND OF THE INVENTION

1. Field of the Invention

The present invention relates to a cavity surrounded by a turbine casing for a gas turbine and a moving blade with a tip shroud.

2. Description of the Related Art

FIG. 3 is a cross sectional view which schematically shows a conventional gas turbine. In the drawing, reference numeral 1 denotes a main flow gas flowing from a combustor (not shown), reference numeral 2 denotes a casing for a turbine, reference numeral 3 denotes a disc, reference numeral 4 denotes a moving blade mounted to a periphery of the disc and arranged in several stages in an axial direction of the disc, and reference numeral 8 denotes a stationary blade disposed in the axial direction in an alternate manner with the moving blade 4.

In the gas turbine having the above structure, the main flow gas 1 of a high temperature supplied from the combustor (not shown) flows between the moving blade 4 and the stationary blade 8 in the axial direction. The moving blade 4 mounted to the disc 3 is rotated at a high speed so as to drive a rotor,thereby rotating a generator (not shown) connected to the rotor, so that power generation is performed.

FIG. 2 is a cross sectional view which shows a cavity of a tip shroud blade in a conventional gas turbine. In the drawing, reference numerals 3 to 4 denote the elements explained in FIG. 1 mentioned above, reference numeral 5 denotes a cavity, reference numeral 6 denotes a tip shroud for the moving blade 4, and reference numeral 7 denotes a fin disposed on the tip shroud. As shown in the drawing, the cavity 5 is constituted by a portion surrounded by the turbine casing 2, the tip shroud 6 and the fin 7. The volume of this cavity 5 is set to be large enough so as to prevent the rotating portion and the stationary portion from being in contact with each other due to a displacement caused by difference in a thermal expansion. As a result, the main flow gas 1 of a high temperature is entrained into the cavity 5, as shown by an arrow 1*a*, and a very large swirl 1*b* is produced.

As mentioned above, in the tip shroud blade cavity for the conventional gas turbine, since the cavity 5 is large, the main flow gas 1 of a high temperature is entrained and a very large swirl 1*b* is produced within the cavity 5, so that a large pressure loss is produced.

The pressure loss due to the production of the swirl 1*b* causes the lowering of a performance of the gas turbine.

SUMMARY OF THE INVENTION

An object of the present invention is to provide a tip shroud blade cavity which prevents a main flow gas of a high temperature from being entrained within a cavity and makes a swirl produced within the cavity smaller. The object is attained by improving the shape of the cavity formed by a casing of a gas turbine, a tip shroud and a fin, and a shape of an end portion of the tip shroud, thereby making the pressure loss caused thereby smaller so as to improve turbine performance.

The invention provides the following in order to achieve the object mentioned above.

A tip shroud blade cavity is surrounded by a casing and a moving blade with a tip shroud, in which a recess portion having substantially a U shape is formed on a casing side opposite to an upstream end portion of the tip shroud. A projecting portion projecting in a tongue-like manner from the upstream end portion of the tip shround is provided so as to neither be in contact with the recess portion at a time of a cold start nor to be in contact with the recess portion with thermal expansion at the time of a heat run.

In the tip shroud blade cavity in accordance with the present invention, since the recess portion disposed on the casing side and the projecting portion of the tip shroud entering the inside thereof without making contact therewith are provided, the cavity can be made to a minimum size in comparison with the conventional cavity. The minimum size means a minimum size necessary for the purpose that the recess portion of the casing and the tip shroud are not in contact with each other in any and all operating conditions of the gas turbine. In this structure, the main flow gas flows into the tip shroud portion of the moving blade. However, since the space of the cavity is small and the projecting portion enters the inside of the cavity so as not to be in contact with the recess portion even in the case of elongation due to a thermal expansion, the main flow gas of a high temperature is prevented from being entrained within the cavity and the swirl produced within the cavity can be made small. Accordingly, a pressure loss caused thereby can be reduced and the performance of the gas turbine can be enhanced.

DETAILED DESCRIPTION OF THE PREFERRED EMBODIMENT

Figure 1:
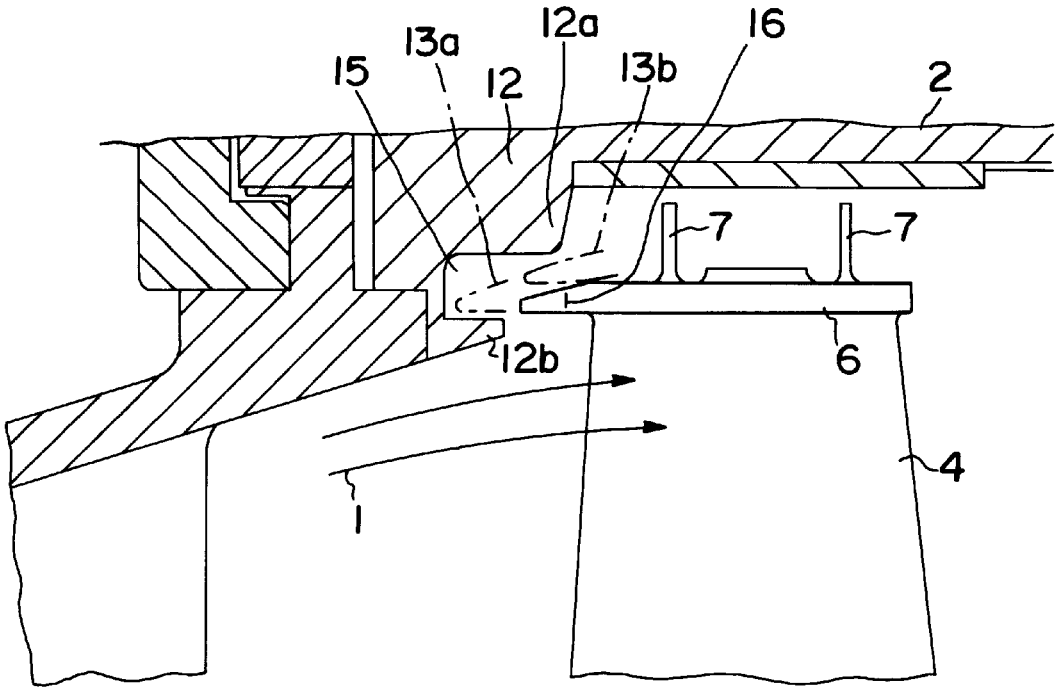
FIG. 1 is a cross sectional view which shows a tip shroud blade cavity in accordance with an embodiment of the present invention.
Figure 2:
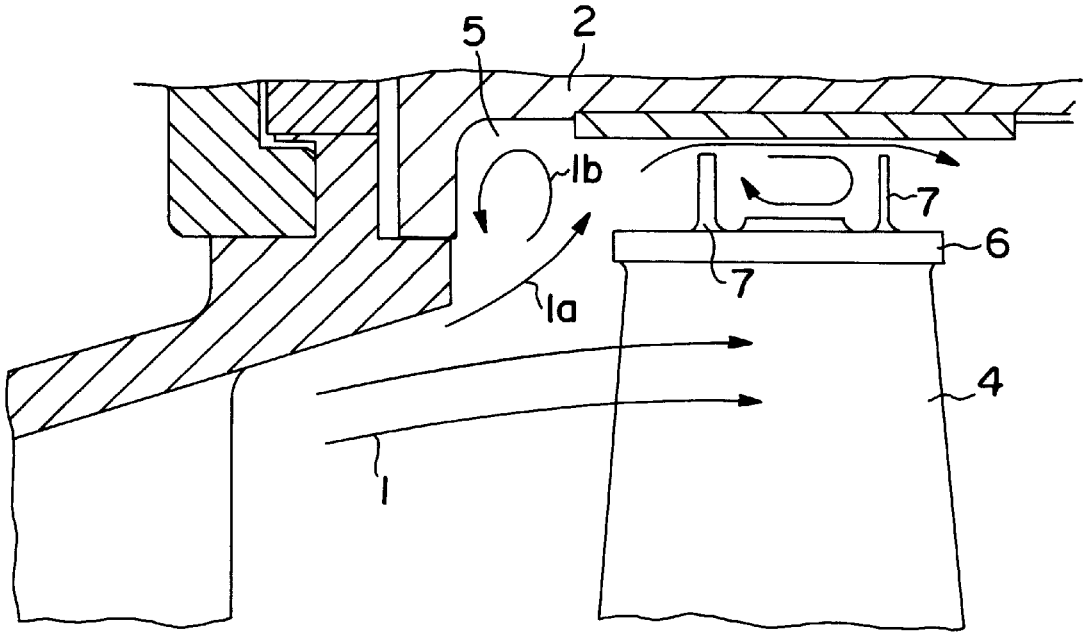
FIG. 2 PRIOR ART
FIG. 2 is a cross sectional view which shows a tip shroud blade cavity portion in a conventional gas turbine.
Figure 3:
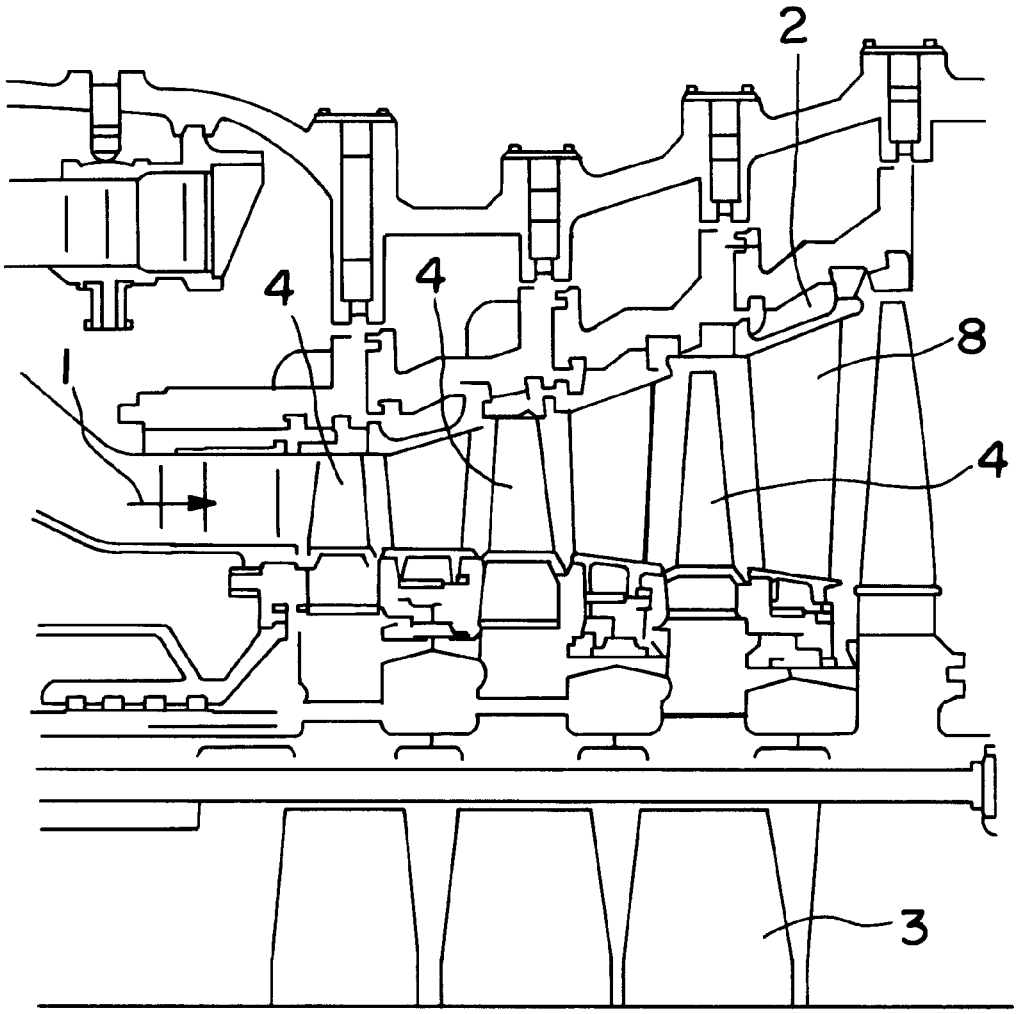
FIG. 3 PRIOR ART
FIG. 3 is a cross sectional view which schematically shows a conventional gas turbine.

An embodiment in accordance with the present invention will be concretely described below with reference to the drawings. FIG. 1 is a cross sectional view which shows a tip shroud blade cavity in accordance with an embodiment of the invention. In FIG. 1, reference numeral 1 denotes a main flow gas of a high temperature and reference numeral 4 denotes a moving blade which has a tip shroud 6 on its tip end, and a fin 7 being provided on the tip shroud 6.

Reference numeral 12 denotes a casing in which an improvement is added to the shape of the conventional casing 2, and as shown in the drawing, a recess portion is provided by a portion 12*a* and a portion 12*b* so as to form a cavity 15 in such a manner as to make the cavity a necessary minimum cavity. Further, an upstream end surface of the tip shroud is improved so that a tongue-like projecting portion 16 is provided.

The tongue-like projecting portion 16 projects toward the cavity 15 within the recess portion, and the cavity 15 is designed so that at time of a cold start, the projecting portion 16 of the tip shroud 6 is received in the cavity 15 without contact therewith as shown by a chain a line 13*a* in the drawing. At the time of a heat run, the improved cavity 15 and the tip shroud 6 are not in contact with each other, even if displacement of the tip shround portion is caused by a difference of a thermal expansion, as shown by a chain line 13*b* in the drawing.

In accordance with the embodiment mentioned above, the cavity 15 is made to a necessary minimum space by the portions 12*a* and 12*b* of the casing 12. Further, the projecting portion 16 is provided to the tip shroud 6 so that the main flow gas 1 can be prevented from being entrained, and the swirl produced within the cavity 15 can be made smaller, thereby reducing pressure loss.

While the preferred form of the present invention has been described, variations thereto will occur to those skilled in the art within the scope of the present inventive concepts which are delineated by the following claim.

What is claimed is:

1. An arrangement in a gas turbine comprising:

a gas turbine casing having an interior with an upstream direction and a downstream direction;

a gas turbine moving blade having a tip shroud on the interior of said gas turbine casing, said tip shroud having an upstream end portion; and a cavity surrounded by said gas turbine casing and said gas turbine moving blade having said tip shroud, said cavity being formed so as to have a recess portion having a substantially U shape formed by said gas turbine casing opposite to said upstream end portion of said tip shroud, and a projecting portion projecting substantially axially toward said recess portion from said upstream end portion of said tip shroud so as to neither contact with said recess portion at the time of a cold start nor contact with said recess portion when under thermal expansion at the time of a heat run.

2. The arrangement of claim 1, wherein said recess portion of said cavity is defined on a radially inward side by a portion of said casing lying radially inward of said projecting portion of said tip shroud.

3. The arrangement of claim 1, wherein said projecting portion projecting toward said recess portion from said upstream end portion of said tip shroud is positioned such that at the time of a cold start said projecting portion extends into said recess portion.

* * * * *